US011976413B2

(12) United States Patent
Denha

(10) Patent No.: US 11,976,413 B2
(45) Date of Patent: May 7, 2024

(54) LAUNDRY BASKET

(71) Applicant: Souhayla Denha, Bloomfield Hills, MI (US)

(72) Inventor: Souhayla Denha, Bloomfield Hills, MI (US)

( * ) Notice: Subject to any disclaimer, the term of this patent is extended or adjusted under 35 U.S.C. 154(b) by 0 days.

(21) Appl. No.: 15/953,497

(22) Filed: Apr. 16, 2018

(65) Prior Publication Data

US 2019/0316290 A1 Oct. 17, 2019

(51) Int. Cl.

| | |
|---|---|
| ***D06F 95/00*** | (2006.01) |
| ***B65D 21/08*** | (2006.01) |
| ***B65D 25/06*** | (2006.01) |
| ***B65D 25/30*** | (2006.01) |

(52) U.S. Cl.

CPC ..... *D06F 95/002* (2013.01); *B65D 21/086* (2013.01); *B65D 25/06* (2013.01); *B65D 25/30* (2013.01)

(58) Field of Classification Search

CPC ..... D06F 95/002; B65D 21/086; B65D 25/06; B65D 88/52; B65D 21/68; B65D 1/0292; B65D 21/068; B65D 11/00; B65D 11/18; B65D 25/30

USPC ..... 220/533, 694

See application file for complete search history.

(56) References Cited

U.S. PATENT DOCUMENTS

| | | | | |
|---|---|---|---|---|
| 8,381,936 | B1 * | 2/2013 | Blake | D06F 95/002 220/500 |
| 2008/0202976 | A1 * | 8/2008 | Burgess | A47B 88/994 206/558 |
| 2015/0041352 | A1 * | 2/2015 | Huang | B65D 85/48 206/454 |
| 2016/0176577 | A1 * | 6/2016 | Frankenberg | B65D 25/06 220/533 |
| 2018/0371685 | A1 * | 12/2018 | Ausi | B65D 25/06 |

* cited by examiner

*Primary Examiner* — Kareen K Thomas

(74) *Attorney, Agent, or Firm* — NEXUS LAW PLLC; Leonard Raykinsteen

(57) ABSTRACT

A laundry basket (the basket) of the present invention includes two portions or halves wherein one of the portions or halves extends into the other one to be able to be adjusted between an initial position and an adjusted position. Each portion or half includes side walls, a rear wall, a front wall, and a bottom including a plurality of openings. The rear wall and the front wall include handles defined therein for carrying the basket. The basket includes a divider wall inserted and secured by a pair of female connectors connected to and extending from the side walls. An advantage of the present invention is to provide a novel improved laundry basket that can expand into various lengths to accommodate storage and transportation of various loads of laundry and other articles.

8 Claims, 4 Drawing Sheets

LAUNDRY BASKET

RELATED APPLICATION

This application is a continuation in part application that claims priority to U.S. non-provisional application Ser. No. 15/632,323 filed on Jun. 24, 2017 and incorporated herewith by reference in its entirety.

FIELD OF THE INVENTION

The present invention relates to a laundry basket and, more particularly, to a laundry basket that is used for carrying dirty laundry, clothes washing products, and coins for commercial washing and drying machines.

BRIEF DESCRIPTION OF THE INVENTION

Consumers have been using traditional plastic molded laundry baskets since time in memoriam. These baskets come in all sizes and shapes according to personal preference. Presently a large percentage of our population lives in apartments and rental housing and do not have their own washing machines and clothes dryers.

These people periodically take a load of dirty laundry to the commercial laundry for self-washing. In doing so they stack their laundry baskets full of dirty laundry, pile their boxes of detergent, fabric softener, bleach, etc. on top of the load and then struggle with a hand full of change. More often than desired, the person carrying the mountain of laundry and boxes manages to drop one or more items and while attempting to pick them up additional items manage to fall.

The general idea of providing a laundry basket with receptacles or compartments for different types of clothing or to accommodate laundry products is not new. One prior art laundry basket includes some clothes washing products compartment as part of the basket in addition to a section for clothing. Since these compartments are both contained in the context of a standard laundry basket, it offers reduced space for the clothing as well as marginally sufficient space for boxes of laundry products.

It is an object of the invention to provide a novel improved laundry basket that provides a separate compartment for dirty laundry and washing products.

It is also an object of the invention to provide a novel improved laundry basket that has a quick release structure on the edges of a divider panel that allows it to be easily attached and detached from the basic laundry basket structure.

It is a further object of the invention to provide an improved novel laundry basket that is economical to manufacture and market.

SUMMARY OF THE INVENTION

A laundry basket (the basket) of the present invention includes two portions or halves wherein one of the portions or halves extends into the other one to be able to be adjusted between an initial position and an adjusted position. Each portion or half includes side walls, a rear wall, a front wall, and a bottom including a plurality of openings. The rear wall and the front wall include handles defined therein for carrying the basket. The basket includes a divider wall inserted and secured by a pair of female connectors connected to and extending from the side walls. Each female connector includes a top portion connected and extending from each of the side walls, an extension portion extending perpendicular to the top portion and presenting a pocket portion defined by V-shaped neck portion with side edges spaced by an elongated slot adaptable to receive side ribs or extensions of the divider includes a pair of side terminal end each terminates to the side ribs. The laundry basket can be formed from any material including and not limited to polymer, metal, wood, and combination thereof without limiting the scope of the present invention. The divider wall is adaptable to selectively separate the laundry basket between several positions wherein one position separates the laundry basket into two equal parts and a second position where the laundry basket is separated into two sections with one section being smaller than the second section and a third position wherein one of the section is divided into two sections.

This laundry basket has been designed to solve many problems presently experienced by people who use commercial coin operated laundry facilities when washing their clothes. The basic structure of the laundry basket is preferably rectangular in shape. A divider panel has fastening structure on its side edges that mate with structure on the respective side walls of the basket and provide a quick release structure.

An advantage of the present invention is to provide a novel improved laundry basket that provides a separate compartment for dirty laundry and washing products.

Another advantage of the present invention is to provide a novel improved laundry basket that can expand into various lengths to accommodate storage and transportation of various loads of laundry and other articles.

Still another advantage of the present invention is to provide a novel improved laundry basket that has a quick release structure on the edges of a divider panel that allows it to be easily attached and detached from the basic laundry basket structure.

Still another advantage of the invention to provide an improved novel laundry basket that is economical to manufacture and market.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
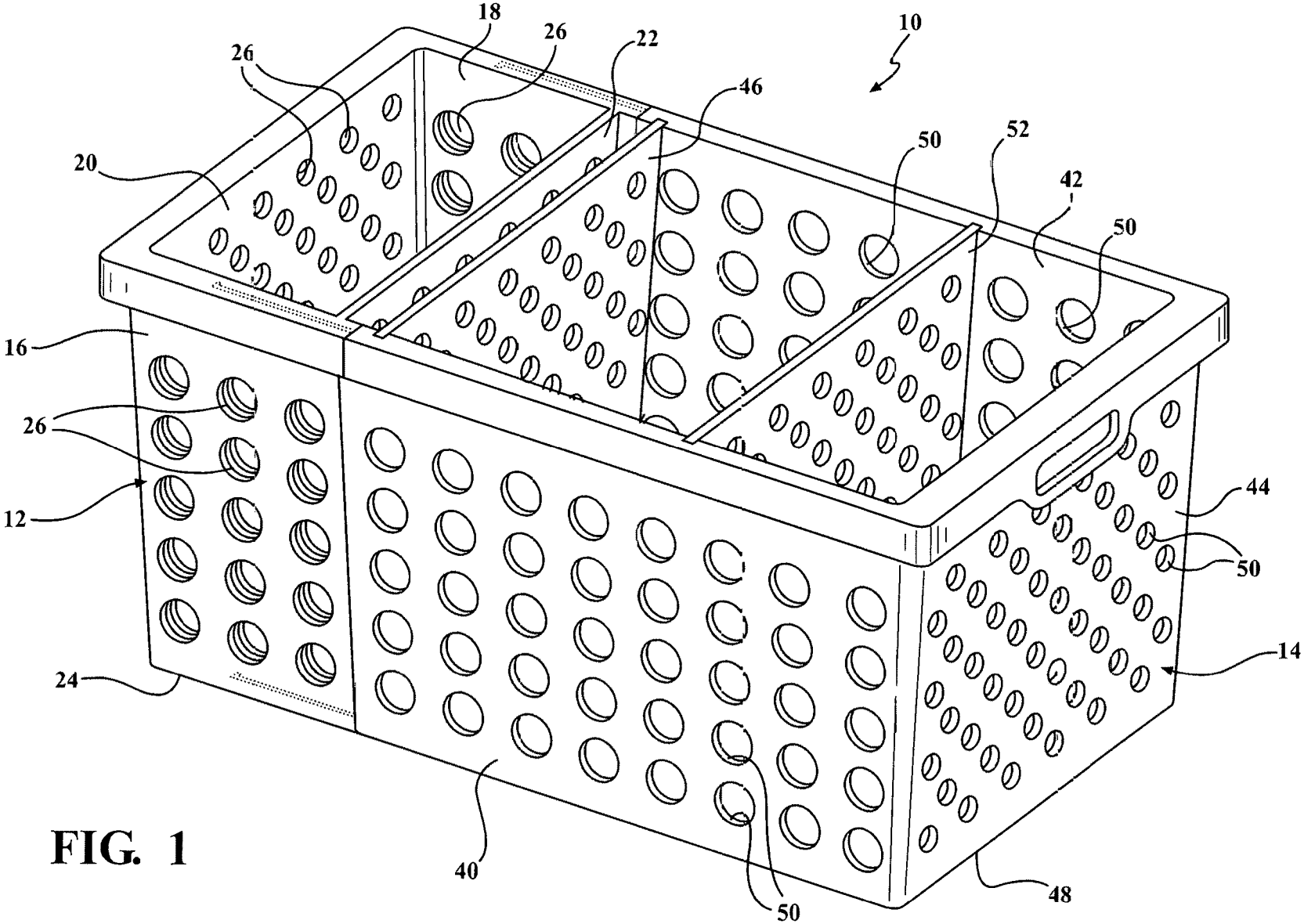
FIG. 1 illustrates a perspective view of an adjustable laundry basket of the present invention in an initial position.
Figure 3:
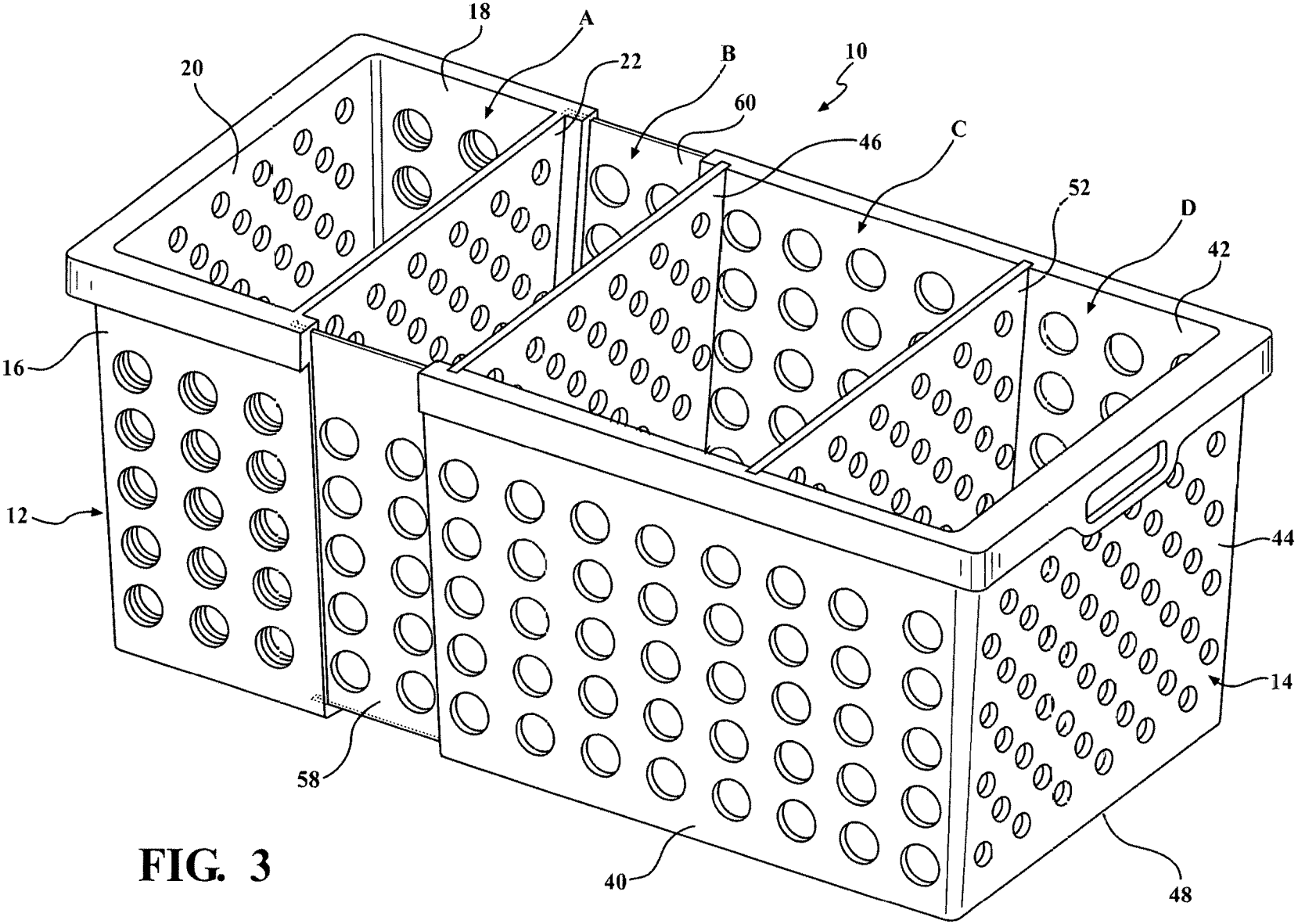
FIG. 3 illustrates a perspective view of the adjustable laundry basket of the present invention in an adjusted position.

Referring to the Figures, wherein like numerals indicate like or corresponding parts, a laundry basket (the basket) of the present invention is generally shown at 10 in FIGS. 1 through 3. The basket 10 includes two portions or halves, generally indicated at 12 and 14. The half 12 is shorter in length that the other half 14. The halves 12 and 14 extends into one another and are adjusted between an initial position (shown in FIG. 1) and an adjusted position (shown in FIG. 3). The half 12 includes side walls 16, 18, a rear wall 20, a front wall 22, and a bottom 24. The side walls 16, 18, the rear wall 20, the front wall 22, and the bottom 24 include a plurality of openings 26. The front wall 22 extends between the side walls 16, 18. Alternatively, the front wall 22 maybe slidably inserted into grooves defined in each wall 16 and 18 (not shown). The side walls 16, 18 include internal channels 30 and 32 extending to respective keyways 34, 36 to be described further.

The half 14 includes side walls 40, 42, a rear wall 44, a front wall 46, defined by a divider, slidably movable away from the side walls 40, 42 and inserted thereto, and a bottom 48. The side walls 40, 42, the rear wall 44, the front wall 46, and the bottom 48 include a plurality of openings 50. The front wall 46 extends between the side walls 40, 42. The side walls 40, 42 include at least two grooves to receive the front wall 46, acting as a first divider, and a second divider 52.

Figure 5:
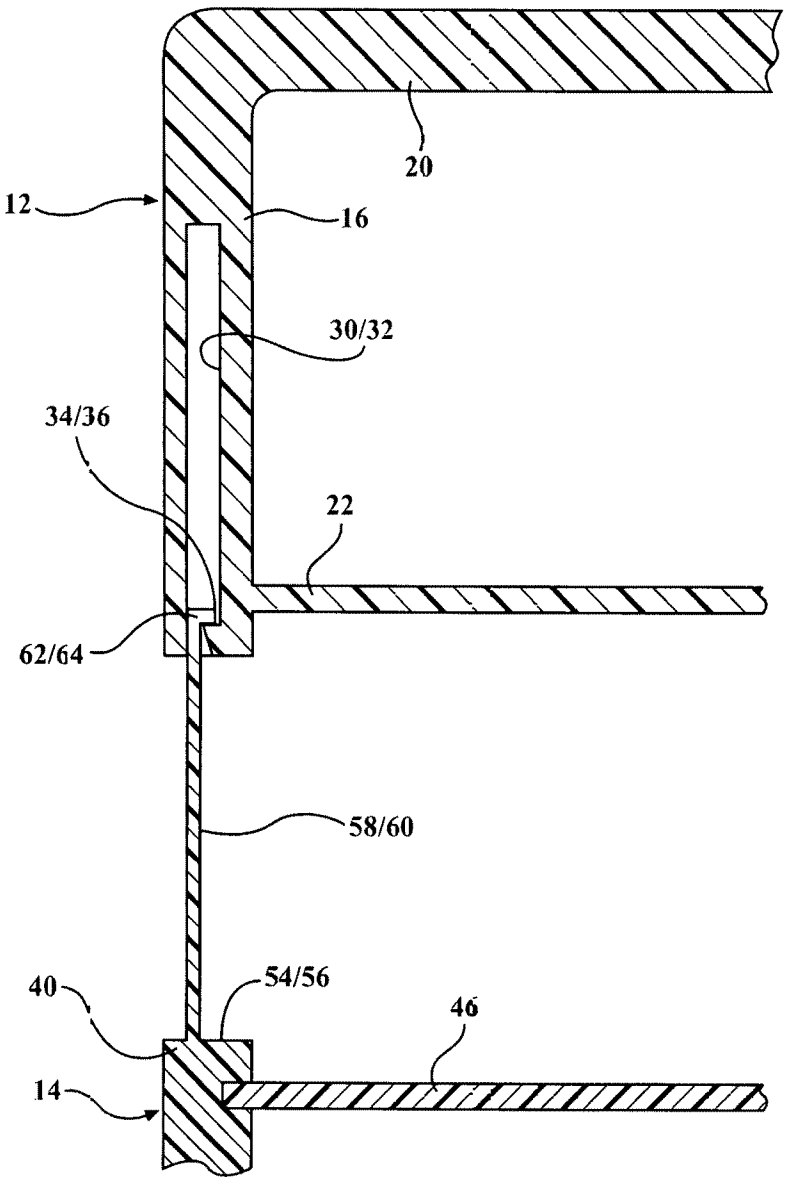
FIG. 5 illustrates a partial cross-sectional view of the first halve or portion of the basket and the second halve or portion of the basket in the adjusted position.
Figure 4:
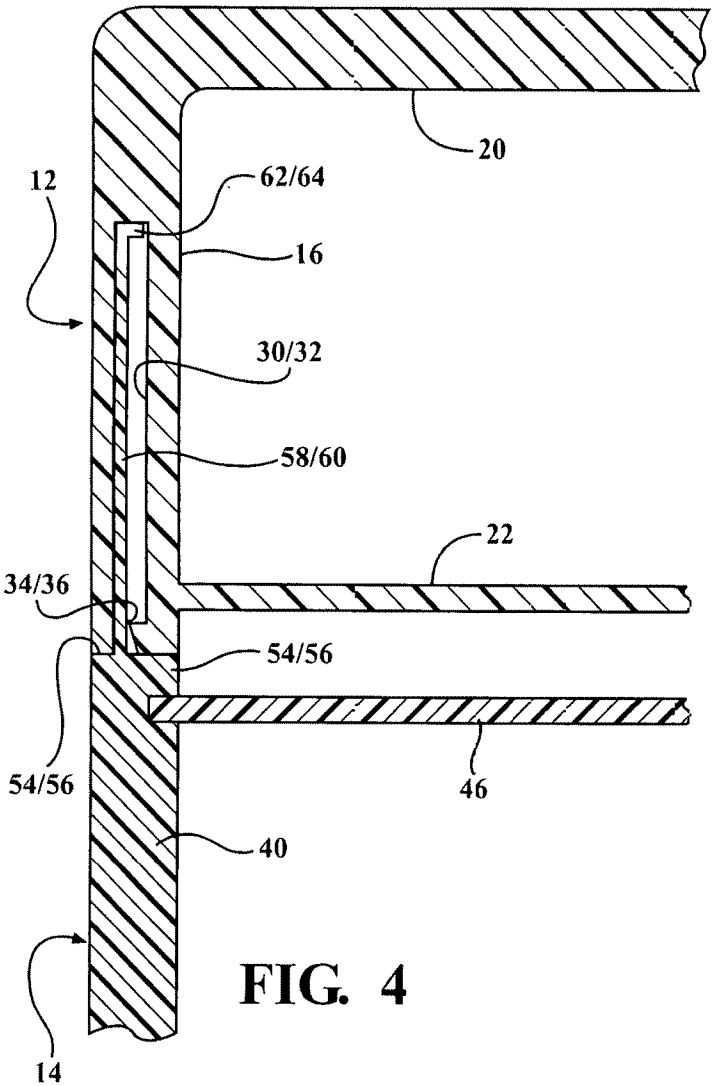
FIG. 4 illustrates a partial cross-sectional view of a first halve or portion of the basket and a second halve or portion of the basket in the initial position.

As best shown in FIGS. 4 and 5, the side walls 40, 42 include terminal ends 54, 56 extending to inserting walls 58, 60 terminating to key portions 62, 64 to slidably movable inside the internal channels 30 and 32. The respective keyways 34, 36 act as stoppers and prevent the key portions 62, 64 to escape from the internal channels 30 and 32. The inserting walls 58, 60 slidably movable inside the internal channels 30 and 32 to allow the half 12 to extend to and from the half 14 at various distances.

Figure 2:
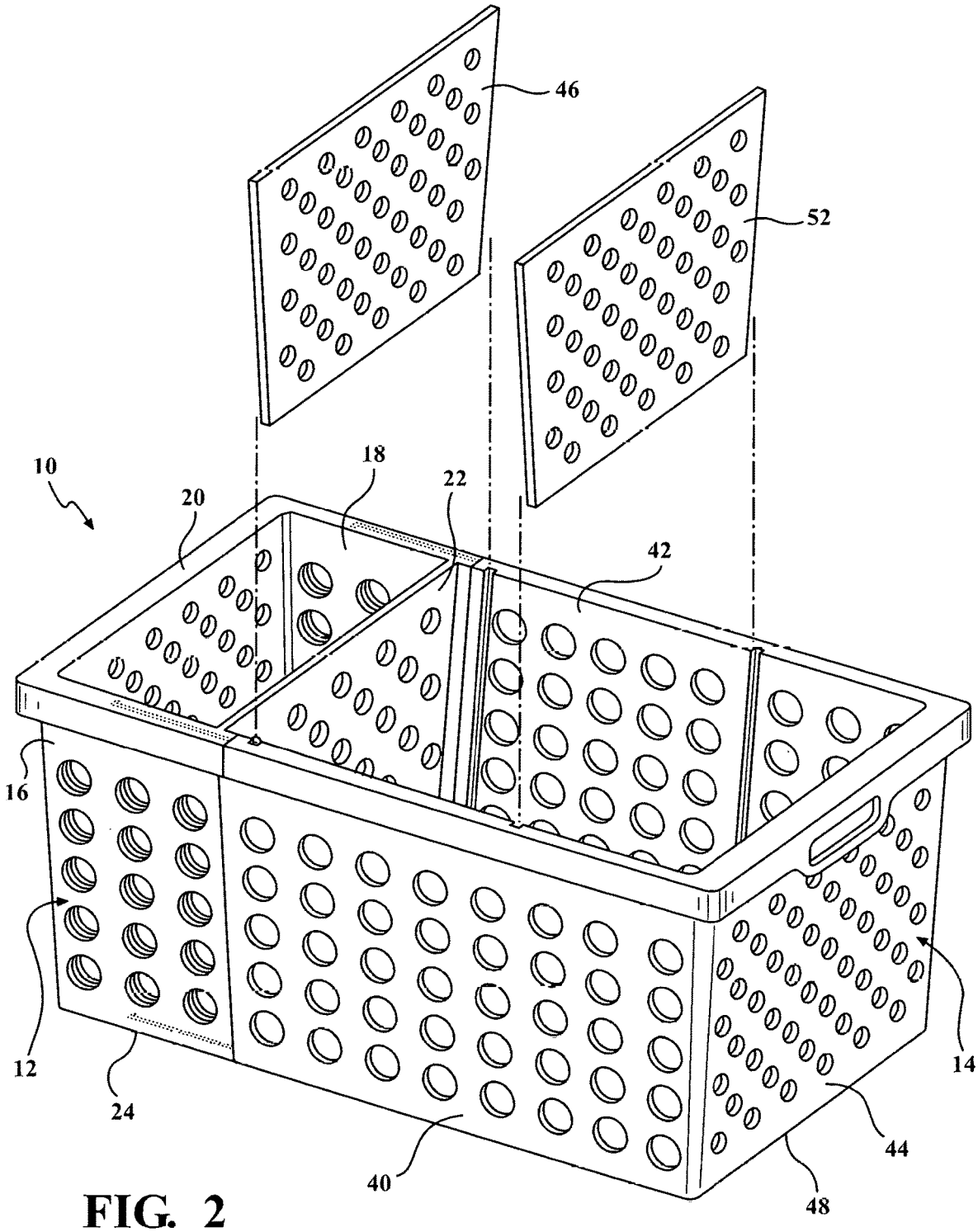
FIG. 2 illustrates a perspective view of the adjustable laundry basket with dividers extended away from the adjustable laundry basket.

As best shown in FIGS. 1 and 3, the basket 10 includes for sections, generally indicated at A, B, C, and D, as shown in FIG. 1. As the basket 10 is moved from the initial position, section B will change its size and can have the same size as the sections A, C, and D or can be longer that the sections A, C, and D, as shown in FIGS. 3 and 5. Alternatively, as shown in FIG. 2, the front wall 46, acting as the first divider, and the second divider 52 are now removed. Now, the basket will only have the section A and a section E. The section A will remain the same and the section E may have various length as the half 12 extends away from the half 14.

The laundry basket 10 can be formed from any material including and not limited to polymer, metal, wood, and combination thereof without limiting the scope of the present invention.

An advantage of the present invention is to provide a novel improved laundry basket 10 that can expand into various lengths to accommodate storage and transportation of various loads of laundry and other articles.

Another advantage of the present invention is to provide a novel improved laundry basket 10 that provides a separate compartment for dirty laundry and washing products.

Another advantage of the present invention is to provide a novel improved laundry basket 10 that has a quick release structure on the edges of a divider panel that allows it to be easily attached and detached from the basic laundry basket structure.

Still another advantage of the invention to provide an improved novel laundry basket 10 that is economical to manufacture and market.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A laundry basket for holding and transporting laundry, the laundry basket comprising:

a first basket portion having a pair of opposing sidewalls, a rear wall and a bottom wall, each of the pair of opposing sidewalls having a top surface defining a top opening of the first basket portion and a bottom surface connected to the bottom wall, each of the pair of opposing sidewalls including an internal channel extending from the top surface to the bottom surface and being enclosed within each of the pair of opposing sidewalls, wherein the internal channel includes a keyway that extends into the internal channel; and a second basket portion having a pair of opposing sidewalls, a rear wall and a bottom wall, each of the pair of opposing sidewalls having a top surface defining a top opening of the second basket portion and a bottom surface connected to the bottom wall, each of the pair of opposing sidewalls comprising a terminal end that includes an inserting wall extending from each terminal end, wherein the inserting wall has a thickness that is less than a thickness of each of the pair of opposing sidewalls of the second basket portion and extends from the top surface to the bottom surface and terminates with a key portion;

wherein the first and second basket portions are interconnected with one another by each inserting wall being slidably inserted into respective one of the internal channels, wherein the first and second basket portions are movable into and away from one another such that the laundry basket is expandable and collapsible between an expanded configuration and a collapsed configuration; and wherein the keyway acts as a stopper preventing the key portion to escape from the internal channel when the laundry basket is in the expanded configuration.

2. The laundry basket of claim 1, wherein the thickness of the inserting wall is less than a thickness of each of the pair of sidewalls of the first basket portion, and wherein the keyway and the key portion are extending in opposite directions relative to one another.

3. The laundry basket of claim 1, wherein the first basket portion includes a front wall extending between and being permanently secured to the pair of opposing sidewalls of the first basket portion.

4. The laundry basket of claim 1, wherein the first basket portion includes a front wall removably inserted into grooves of the pair of opposing sidewalls of the first basket portion.

5. The laundry basket of claim 1, wherein the second basket portion includes a pair of opposing grooves to receive respective one of a first divider wall and a second divider wall.

6. The laundry basket of claim 5, wherein the first and second divider walls include a plurality of openings or perforations.

7. The laundry basket of claim 1, wherein the pair of opposing sidewalls, the rear walls and the bottom walls of each of the first and second basket portions include a plurality of openings or perforations, and wherein the inserting walls of the second basket portion include a plurality of openings or perforations.

8. The laundry basket of claim 7, wherein the plurality of openings or perforations of each inserting wall are configured to align with the plurality of openings or perforations of respective one of the pair of opposing sidewalls of the first basket portion when the laundry basket is in the collapsed configuration.

* * * * *